United States Patent [19]

Wafer et al.

[11] 4,245,203

[45] Jan. 13, 1981

[54] CIRCUIT INTERRUPTER WITH PIVOTING CONTACT ARM HAVING A CLINCH-TYPE CONTACT

[75] Inventors: John A. Wafer, Beaver, Pa.; Miguel B. Yamat, Greendale, Wis.

[73] Assignee: Westinghouse Electric Corp., Pittsburgh, Pa.

[21] Appl. No.: 951,940

[22] Filed: Oct. 16, 1978

[51] Int. Cl.[3] ..... H01H 75/00; H01H 77/00; H01H 9/20

[52] U.S. Cl. ..... 335/16; 200/244; 335/170

[58] Field of Search ..... 335/15, 16, 21, 22, 335/167, 168, 169, 170, 171, 172, 173, 174, 195; 200/237, 238, 239, 244, 273, 274

[56] References Cited

U.S. PATENT DOCUMENTS

| | | | |
|---|---|---|---|
| 2,349,631 | 5/1944 | Lindstrom et al. | 335/21 |
| 3,343,108 | 9/1967 | Murai | 335/16 |
| 3,365,561 | 1/1968 | Jencks et al. | 200/244 X |
| 3,469,216 | 9/1969 | Shiraishi | 335/195 |
| 3,991,391 | 11/1976 | Wafer | 335/16 |
| 4,013,984 | 3/1977 | Wafer | 335/185 |
| 4,031,492 | 6/1977 | Wafer | 335/16 |
| 4,077,025 | 2/1978 | Slade et al. | 335/16 |
| 4,132,968 | 1/1979 | Lang | 335/16 |

FOREIGN PATENT DOCUMENTS 1214363 12/1970 United Kingdom .

*Primary Examiner*—Fred L. Braun

*Attorney, Agent, or Firm*—Robert E. Converse, Jr.

[57] ABSTRACT

A circuit interrupter includes two parallel pivoting contact arms, the lower of which is connected to a stationary conductor member using a clinch-type contact. The contact arm has an axle member rigidly attached thereto which is supported by a bearing member attached to the conductor. In one embodiment, the bearing member comprises a pair of bifurcated arms which are clamped about each end of the axle member. In an alternative embodiment, the conductor member lies generally parallel to the lower contact arm and is slotted to form a pair of elongated conductor arms, each of which supports a journal bearing member. One end of the axle is extended through each journal bearing.

13 Claims, 8 Drawing Figures

CLOSED POSITION

NORMAL OPEN POSITION

TRIP POSITION

CURRENT LIMITING POSITION

CIRCUIT INTERRUPTER WITH PIVOTING CONTACT ARM HAVING A CLINCH-TYPE CONTACT

CROSS REFERENCE TO RELATED APPLICATIONS

The invention is related to material disclosed in copending U.S. patent application Ser. No. 951,939, entitled "Current Limiting Circuit Interrupter with Improved Operating Mechanism", filed Oct. 16, 1978 by Miguel B. Yamat, and U.S. patent application Ser. No. 951,938 filed Oct. 16, 1978 by Walter W. Lang, John A. Wafer, and Miguel B. Yamat.

BACKGROUND OF THE INVENTION

1. Field of the Invention

The present invention relates to electrical apparatus and, more particularly, to circuit interrupters having pivoted contact arms.

2. Description of the Prior Art

The circuit interrupters are widely used to provide protection for electrical distribution systems against damage caused by overload current conditions. Many circuit interrupters employ pivoting arms supporting a movable contact which cooperates with another contact (either movable or stationary) to open and close an electrical circuit. The most common means of connecting the movable contact to stationary conductors connected to the breaker terminals is through the use of a flexible wire or shunt. However, these flexible shunts are subjected to much movement over the life of the circuit breaker, and are susceptible to fatigue and other types of failure. It would therefore be desirable to provide a circuit interrupter having a pivoting movable contact arm which does not require flexible shunt.

SUMMARY OF THE INVENTION

In accordance with the preferred embodiment of the present invention, there is provided a circuit interrupter which includes separable contacts, at least one of which is supported upon a movable pivoting contact arm. The arm includes an axle member rigidly secured to and extending through one end of the contact arm. The circuit interrupter also includes slotted conductor means having a bifurcated member supporting the axle member to allow pivoting movement of the contact arm. Current flow through the contacts also flows through the conductor means to cause the bifurcated member to squeeze together and generate a clamping contact force on the contact arm and provide a low resistance path between the conductor means and the contact arm. Premature contact blow-off and subsequent contact welding are thus also prevented. In one embodiment of the invention, the conductor means comprises a journal member having a pair of bifurcated upright arms perpendicular to the axle member, each of the upright arms holding the axle member between the bifurcations thereof, with the clamping contact force being exerted radially upon the axle member. In an alternative embodiment, the conductor means comprises a slotted bifurcated conductor member lying substantially in the same plane as the contact arm, the conductor member comprising a pair of arm members each of which supports a journal member. The axle member extends through each of the journal members to allow the contact arm to pivot thereon. Current flow through the contacts also flows through each of the arm members to cause the arm members to squeeze together and generate a clamping contact force between the journal members upon the contact arm in a direction parallel to the axle member.

DESCRIPTION OF THE PREFERRED EMBODIMENT

Figure 1:
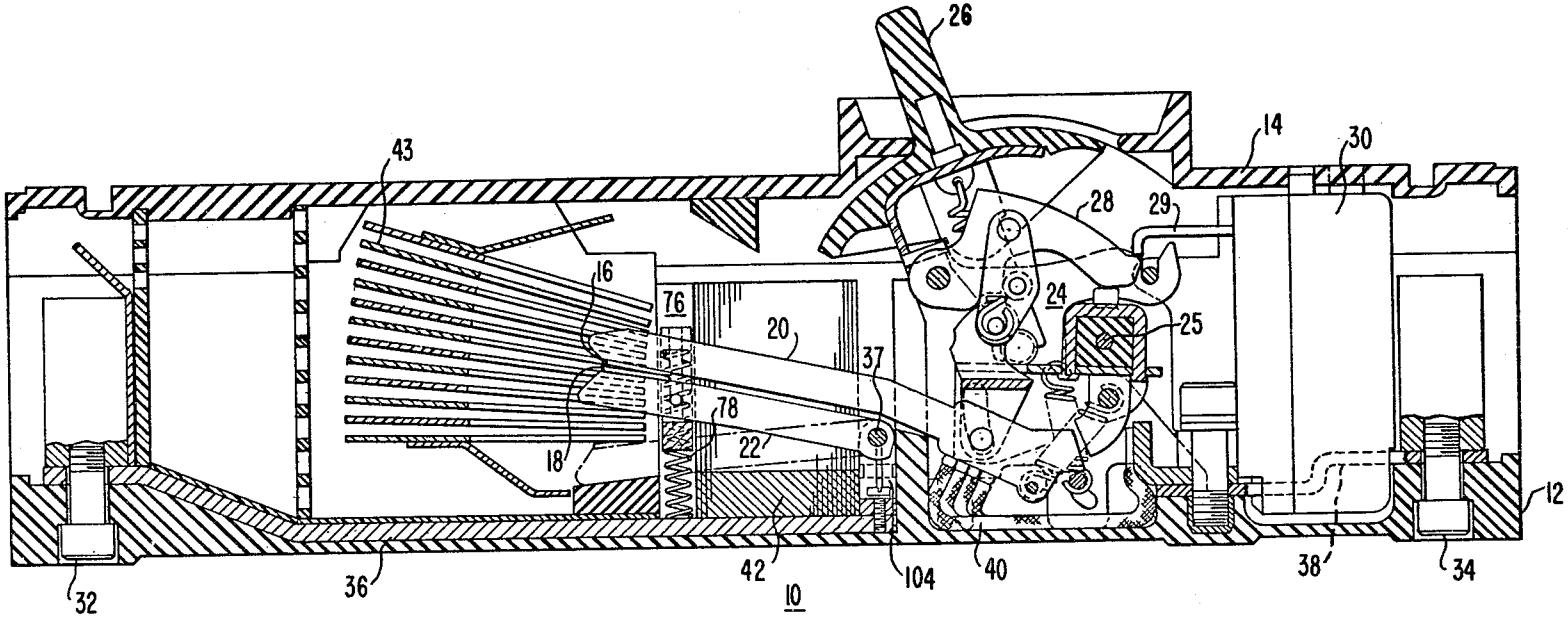
FIG. 1 is a side sectional view of a current limiting circuit breaker incorporating the principals of the present invention.

Referring now to the drawings, in which like reference characters refer to corresponding members, FIG. 1 shows a side sectional view of a current limiting circuit breaker 10 employing the principles of the present invention. The circuit breaker 10 includes a molded insulating housing 12 and a cooperating molded insulating cover 14. Upper and lower separable contacts 16, 18 are secured at the ends of upper and lower pivoting contact arms 20 and 22, respectively. Movement of the upper contact arm 20 is controlled by an operating mechanism indicated generally at 24 which is adapted for manual operation through a handle 26. Automatic opening operation upon normal overload currents is provided by a releasable latch 28 held during normal electrical conditions by a member 29 attached to a trip unit 30. The trip unit 30 may include thermal, magnetic, and shunt trip mechanisms of conventional design and will not be here described in detail. Low to moderate overload current conditions as detected by the trip unit 30 will result in movement of the member 29 to release the latch 28 and allow the contact arm 20 to pivot upward.

Terminals 32 and 34 are adapted to connect the circuit breaker 10 in series circuit relationship with an electrical circuit to be protected. Conductors 36 and 38 are connected to terminals 32 and 34 respectively. The lower contact arm 22 is electrically connected to the conductor 36 with a clinch-type contact 37 including arms 104 to be more completely described hereinafter. A conductive shunt 40 is electrically connected between the upper contact arm 20 and the conductor 38. With the circuit interrupter 10 in the closed circuit position as shown in FIG. 1, an electrical circuit thus exists from the terminal 32 through the conductor 36, the connection 37, the contact arm 22, contact 18, contact 16, upper contact arm 20, shunt 40, and conductor 38 to the terminal 34. A slotted magnetic drive device, or slot motor, 42 operates to aid in rapid separation of the contact arms 20, 22 during current limiting operation, as will be more completely described hereinafter. Plates 43 are provided to aid in extinguishing an arc established by separation of the contacts 16, 18.

Figure 2:
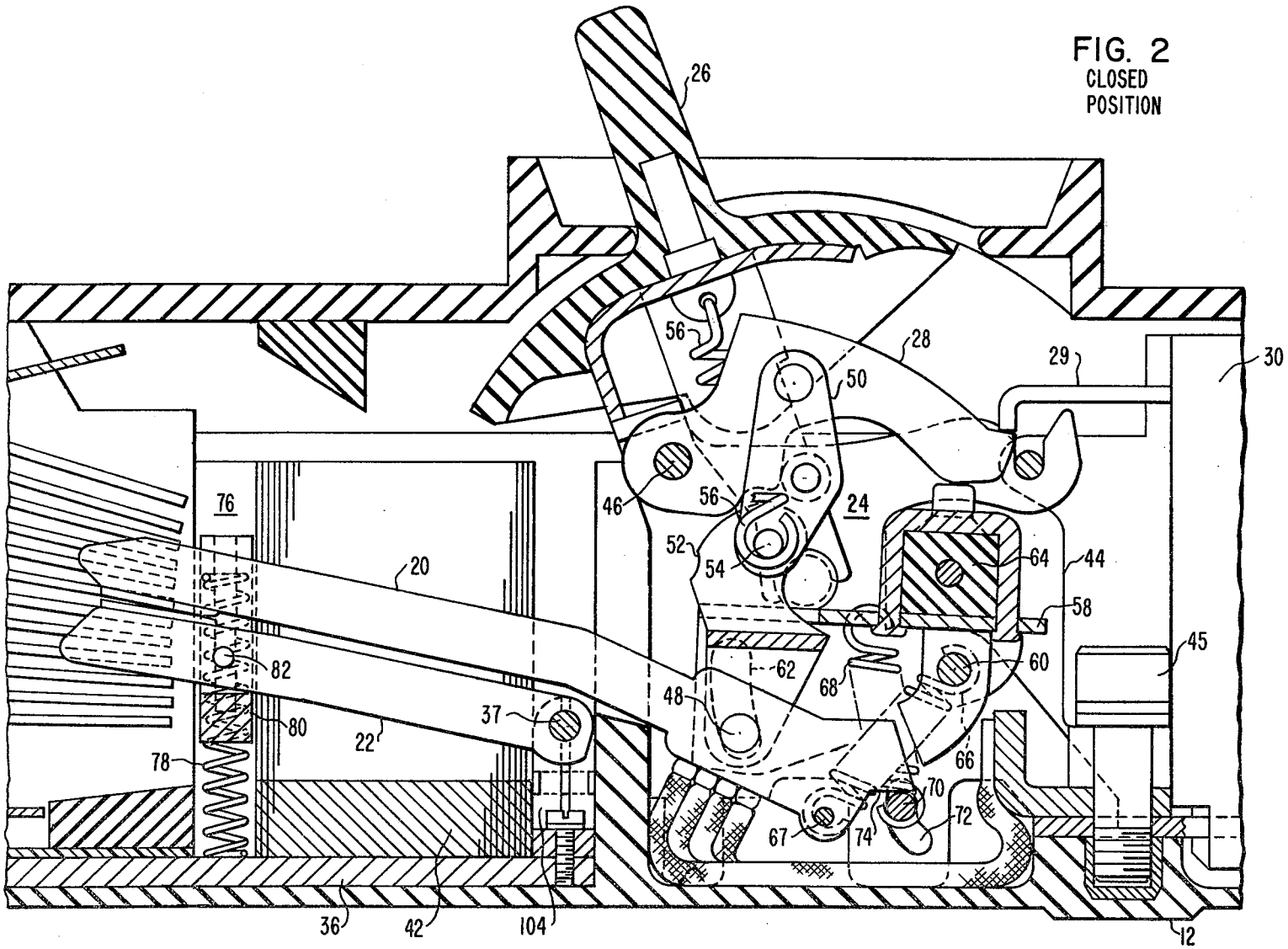
FIG. 2 is a detail side sectional view of the contact arms and operating mechanism of the circuit breaker shown in FIG. 1, with the contacts in the closed position.

The construction of the operating mechanism 24 is shown in more detail in FIG. 2. A mechanism frame having side plate members 44 is secured to the housing 12 by a screw 45. The trip latch 28 is attached by a latch pivot pin 46 to the side plates 44. A toggle linkage consisting of an upper toggle link 50 and a lower toggle link 52 is pivotally connected between the trip latch 28 and the upper contact arm pivot pin 48. The upper and lower toggle links 50, 52, are joined by a toggle knee pin 54, to which is attached an operating spring 56, also connected to the handle 26.

A U-shaped carriage 58 is pivotally mounted to the side plates 44 upon a carriage pivot pin 60. The upper contact arm pivot pin 48 is mounted in the carriage 58. Therefore, during normal (non-current limiting) operations, the upper contact arm 20 pivots as a unit with the U-shaped carriage 58 about the rod 60. Since the lower toggle link 52 extends through the carriage 58 and is pivotally attached to the contact arm pivot pin 48, the extension or collapse of the toggle linkage 50, 52 serves to rotate the carriage 58 about the pin 60. Movement of the carriage 58 is constrained by slots 62 in the side members 44 within which ride the ends of the pivot pin 48. A cross arm 64 is fixedly secured to the carriage 58, and extends to identical carriages on side poles (not shown).

Light extension springs 66 are connected on both sides of the contact arm 20 between the rod 67 (attached to the arm 20) and the carriage pivot pin 60. Heavy extension springs 68 are connected between the carriage 58 and a movable latch pin 70 which is free to ride in arcuate slots 72 on the frame side members 44. With the circuit breaker in the closed position as shown in FIG. 2, it can be seen that the latch pin 70 is drawn against a reaction surface 74 of the contact arm 20 by the action of the heavy extension springs 68. The springs 66 and 68 are thus extended in tension and the contact arm 20 floats in equilibrium between the contact force, the forces from the springs 66 and 68, and a reaction force produced by the carriage 58 upon the contact arm pivot pin 48.

The lower contact arm 22 is positioned by a spring biased shutter assembly 76 which includes a compression spring 78, a bearing member 80, and a limit pin 82. The compression springs 78 resist the contact force produced by the upper contact arm 20 upon the lower arm 22.

Figure 3:
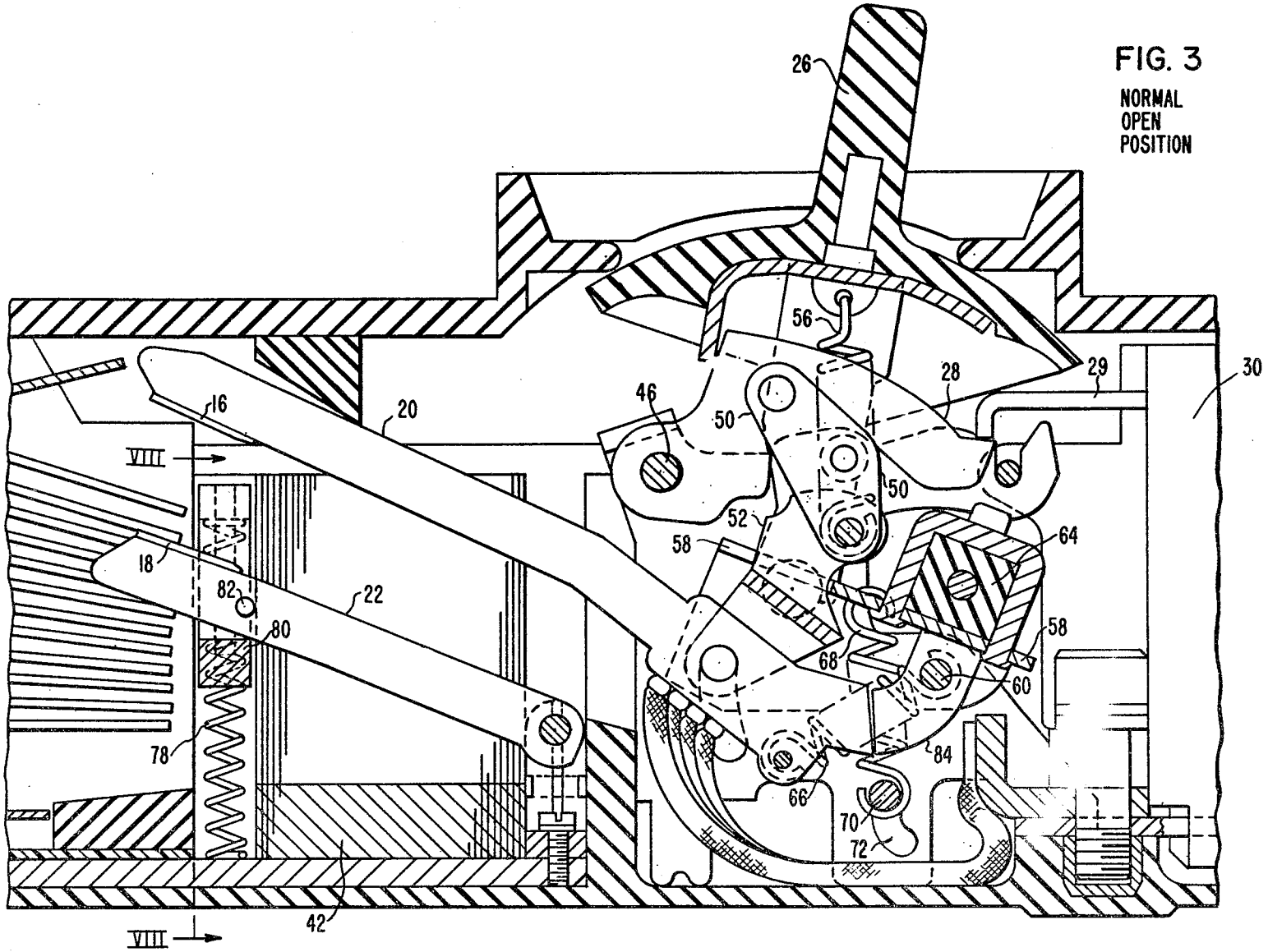
FIG. 3 is a view similar to FIG. 2, with the contacts and operating mechanism shown in the normal open position.

When the circuit breaker is operated to the normal open position by manual operation of the handle 26, the mechanism assumes the position shown in FIG. 3. As can be seen, the upper and lower toggle links 50 and 52 have collapsed, allowing the carriage 58 to rotate in a clockwise direction about the carriage pivot pin 60. The upper contact arm 20 has also pivoted as a unit with the carriage 58 to separate the contacts 16 and 18. The light extension springs 66 operate upon the upper contact arm 20, drawing it up against a pickup block 84 attached to the carriage 58. Force from the heavy spring 68 is no longer acting upon the contact arm 20, since the latch pin 70 (through which the spring force acts when the circuit breaker is in the closed position) is constrained by the upper end of the slot 72 and is no longer in contact with the contact arm 20. The lower contact arm 22 has risen slightly from its closed position shown in FIG. 2 to the position shown in FIG. 3 under the action of the compression spring 78. The upper limit of travel of the lower contact arm 22 is determined by the action of the limit pin 82 against the side of the slot motor 42.

Figure 4:
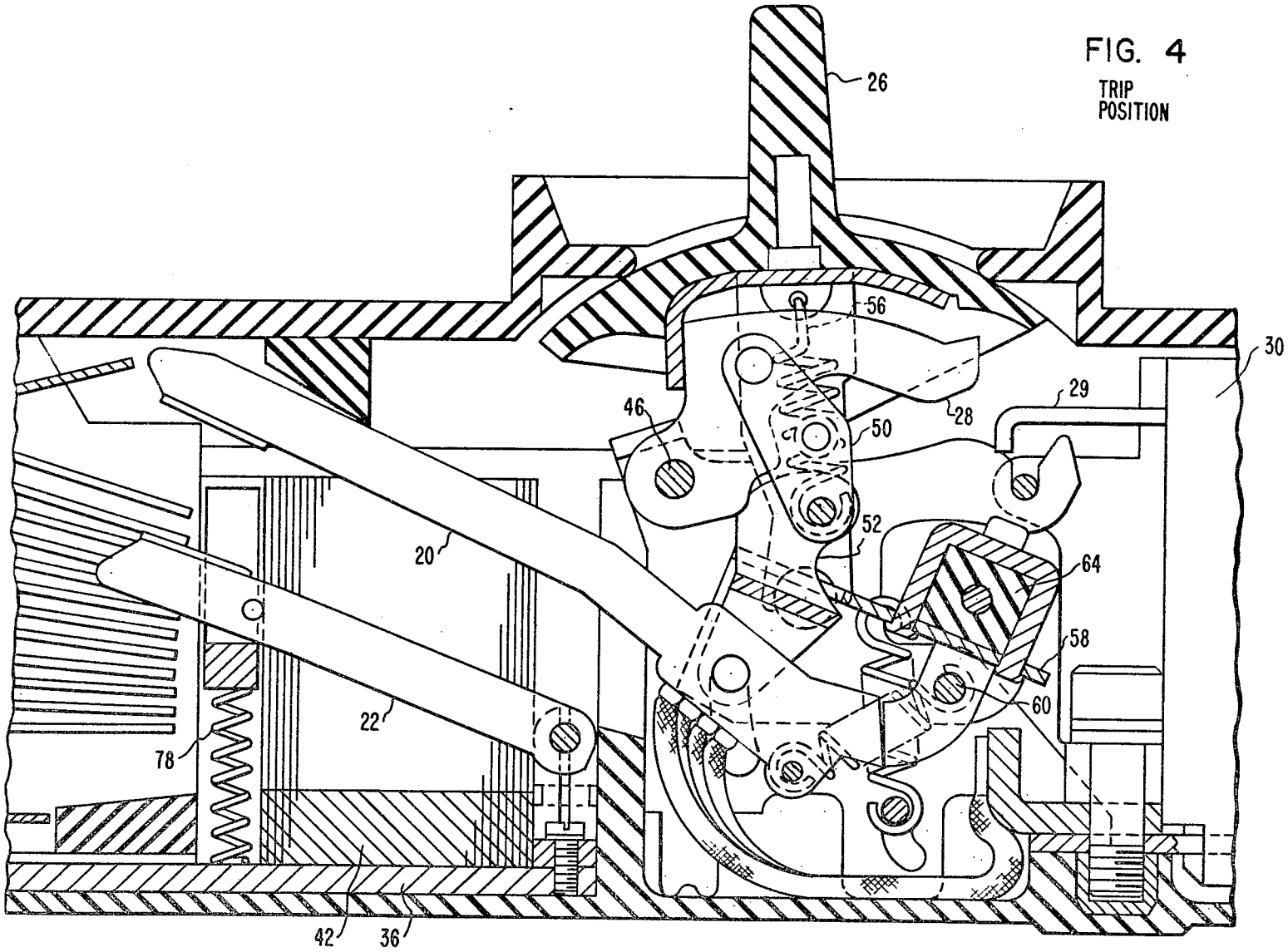
FIG. 4 is a view similar to FIGS. 2 and 3, with the contacts and mechanism shown in the tripped position.

Under low to moderate overload conditions, the trip device 30 will actuate to move the member 29 and release the trip latch 28. The circuit breaker will then assume the position shown in FIG. 4. The trip latch 28 rotates in a counterclockwise direction about the latch pivot 46 under the influence of the extension operating spring 56. This causes the toggle linkage composed of links 50 and 52 to collapse, allowing the carriage 58 to rotate in a clockwise direction about the carriage pivot pin 60. The handle 26 is moved to the center trip position as shown in FIG. 4, and the cross arm 64 rotates with the carriage 58 to open the other poles of the circuit breaker. All other members of the circuit breaker assume the same positions as in the normal open position shown in FIG. 3.

Severe overload currents flowing through the circuit breaker 10 when in the closed position shown in FIG. 2 generate high electrodynamic forces upon the contact arms 20 and 22 tending to separate the contacts 16 and 18 and pivot the arms 20 and 22 in opposite directions. An additional separation force is provided by the current flow through the conductor 36 and arm 22 which induces magnetic flux in the slot motor 42 to overcome the clamping force of the clinch-type contact 37 and pull the arm 22 toward the bottom, or closed end, of the slot. Note that the conductor member 36, the arms 104, and the contact arm 22 form a single turn about the base of the slot motor 42, thereby intensifying the magnetic flux produced.

Since the trip latch 28 and toggle linkage 50, 52 are not immediately affected, they and the carriage 58 remain in the position shown in FIG. 2. Thus, the electrodynamic force upon the upper contact arm 20 causes it to rotate in a clockwise direction about the contact arm pivot pin 48. In the initial stages of this rotation, the reaction surface 74 bears upon the latch pin 70, causing it to move downward in the guide slot 72. At first, the pin 70 moves downward in the guide slot 72 against the action of the spring 68. The force of the spring 68 therefore increases proportionately with the displacement of the contact arm 20, resisting the electrodynamic force caused by overload current and tending to oppose the current limiting action. However, the guide slot 72 is shaped to push the latch pin 70 away from the contact arm 20, and about halfway through the travel of the contact arm (before the spring 68 has appreciably extended), the reaction surface 74 disengages from the latch pin 70, allowing the released force of the spring 68 to pull the latch pin 70 to the top of the guide slot 72. The point at which disengagement occurs between the contact arm 20 and latch pin 70 can, of course, be regulated by proper design of the guide slot 72.

Figure 5:
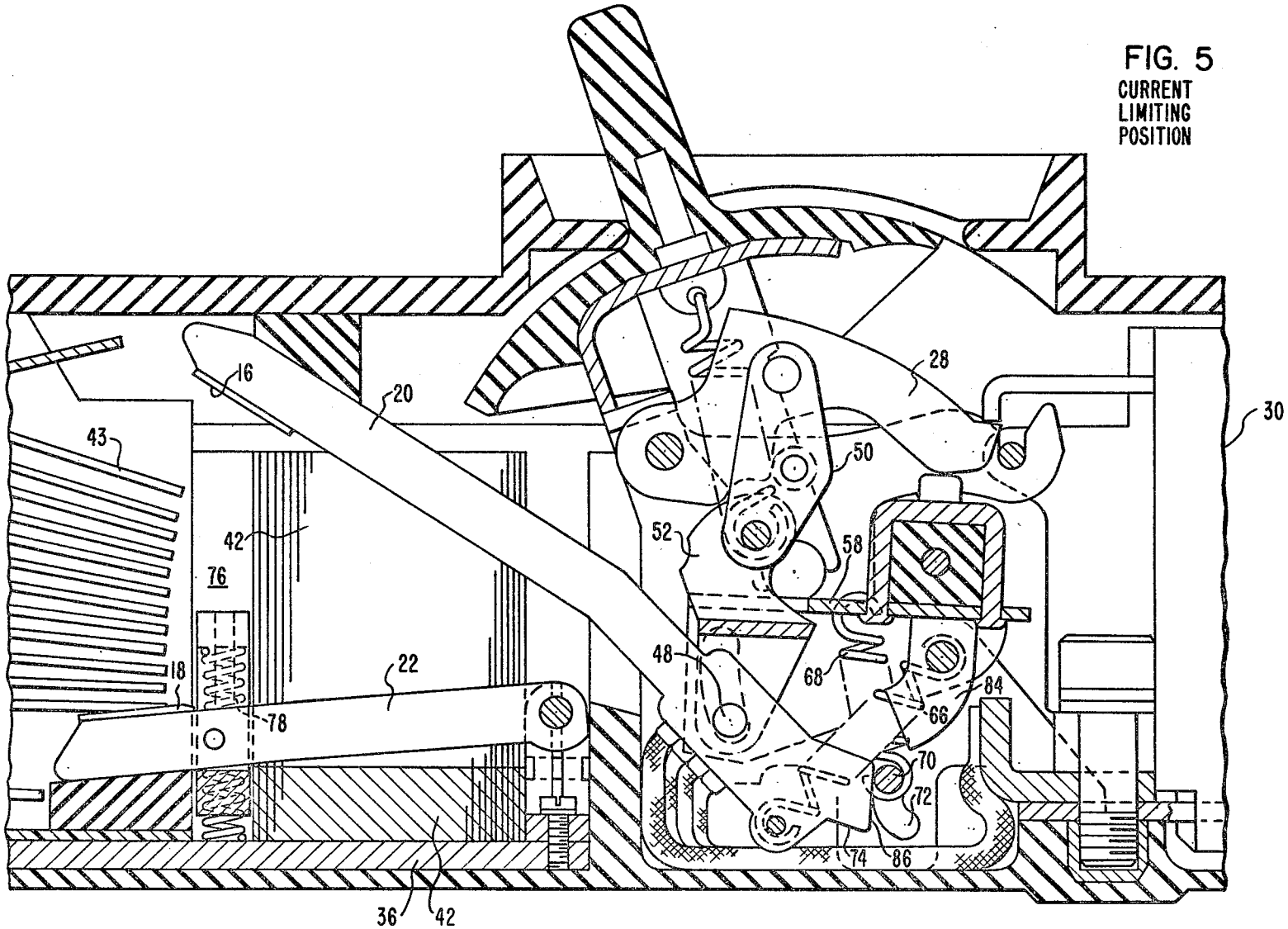
FIG. 5 is a view similar to FIGS. 2 through 4, with the contacts and mechanism shown in a current limiting position.

As can be seen in FIG. 5, when the latch pin 70 is at its upper extremity in the slot 72, it bears against a latch surface 86 of the contact arm 20. Thus, even though the light extension spring 66 is applying force tending to rotate the contact arm 20 in a counterclockwise direction and return the arm 20 to a closed circuit position, this tendency is prevented by the latching action of the latch pin 70.

As the arms 20 and 22 move to the current limiting position of FIG. 5, an arc is drawn between contacts 16 and 18. Although this arc is forced against the plates 43 and is fairly rapidly extinguished thereon, the current flow until arc extinction is sufficient to activate the trip device 30 to release the trip latch 28. This action allows the carriage 58 to rotate in a clockwise direction and the latching surface 86 to ride upward along the latch pin 70 until it is released therefrom. When the carriage 58 has rotated a degree sufficient to release the surface 86 from the latch pin 70, the light extension spring 66 pivots the contact arm 20 in a counterclockwise direction until the surface 86 contacts the pickup block 84. At this time, the circuit interrupter assumes the position shown in FIG. 3.

Figure 6:
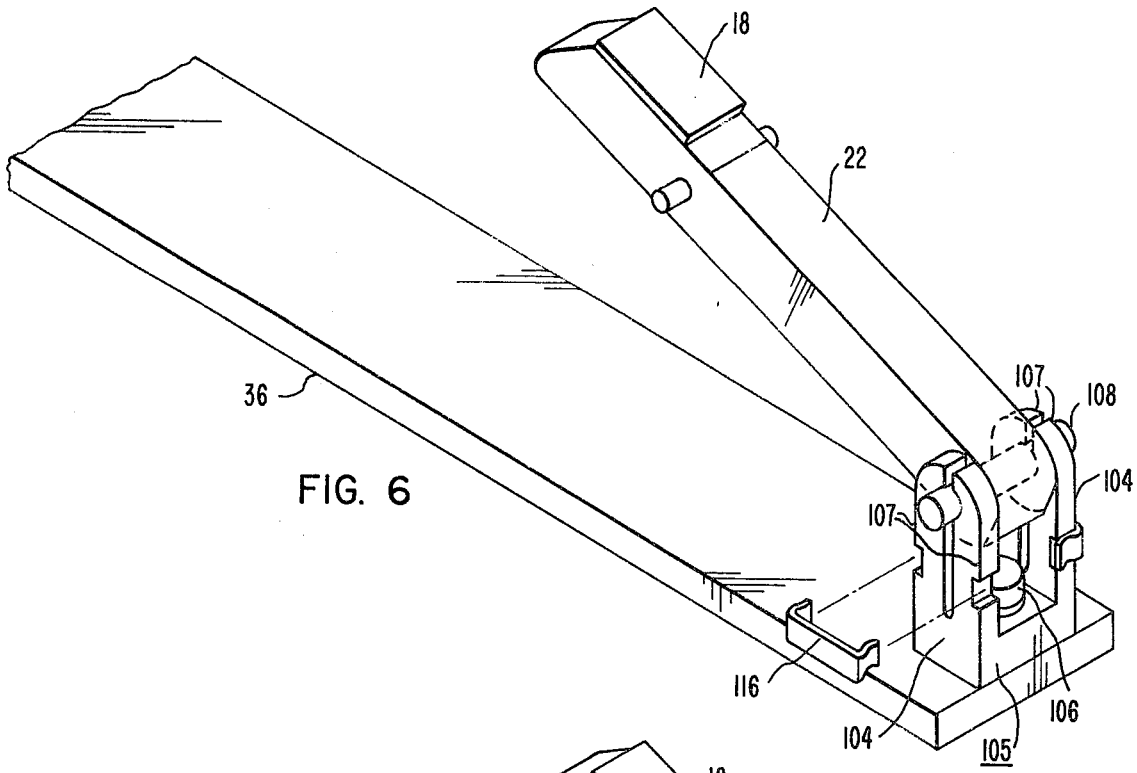
FIG. 6 is a perspective view showing the details of the clinch-type contact connecting a stationary conductor member to the lower movable contact arm of the circuit breaker shown in FIGS. 1 through 5.

The construction of the lower contact arm 22, the conductor member 36, and the clinch-type electrical connection 37 therebetween is shown most clearly in FIG. 6. The conductor member 36 includes a U-shaped bearing member 105 secured to the conducting member 36 by the screw 106. The bearing member 105 includes a pair of bifurcated upright members 104 each having two arms 107 perpendicular to a pivot member, or axle, 108 extending through one end of the contact arm 22 and rigidly secured thereto. Semicircular depressions in the arms 107 grip the axle 108 and position it for pivotal movement of the contact arm 22. Clamping force upon the axle 108 is provided by the resilience of the arms 107 and by a bias spring clip 116 removably mounted in notches of the arms 107. When the contact arms 20 and 22 are in the closed circuit position current flows through the upright members 104 and the arms 107 in parallel, all in the same direction. This current flow causes the arms 107 to squeeze together to generate a radial clamping force upon the axle 108 of the arm 22. This provides a low resistance electrical connection between the arms 107 and the axle 108.

Figure 7:
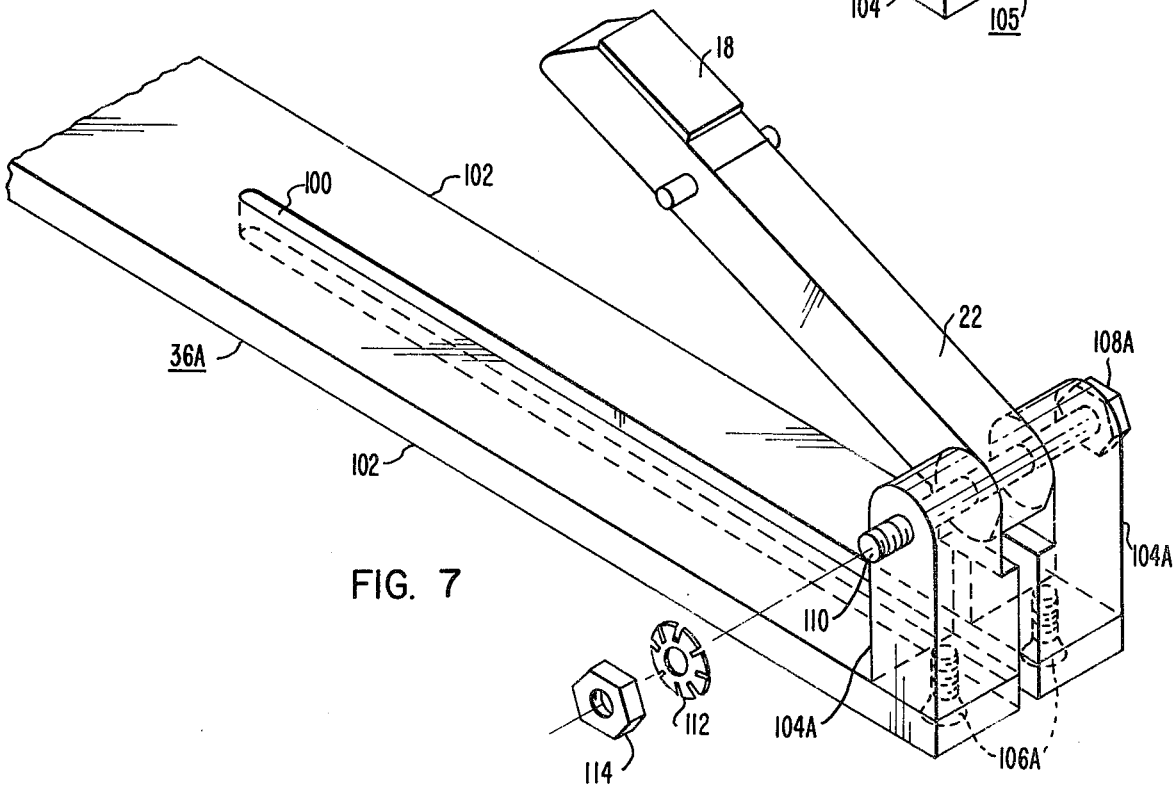
FIG. 7 is a perspective view of an alternative embodiment of the invention showing a different type of clinch contact.
Figure 8:
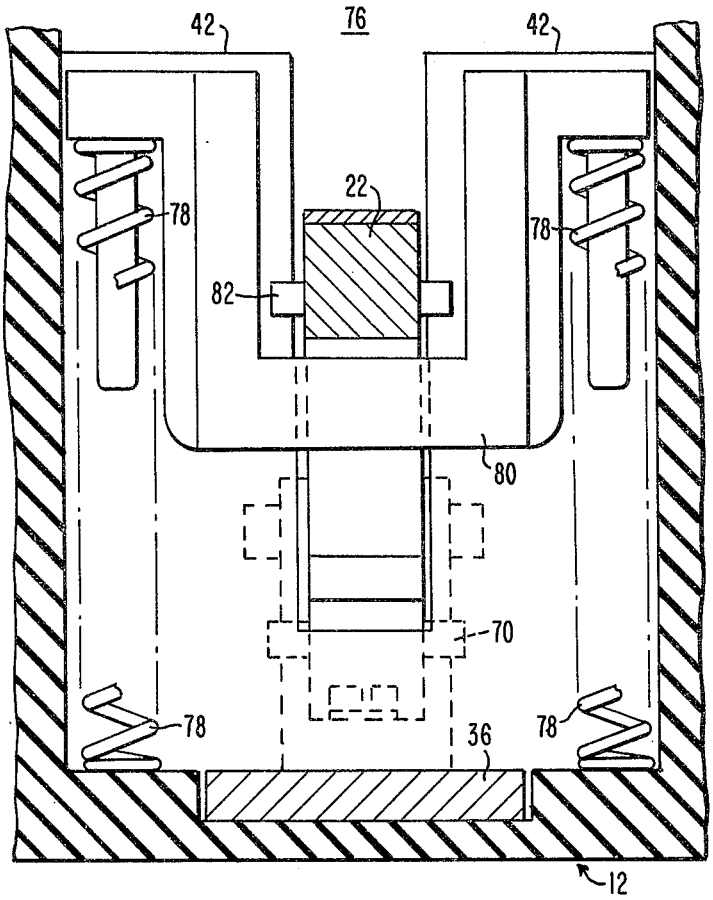
FIG. 8 is a partial sectional view of the circuit breaker of FIG. 1 taken along the line VIII—VIII of FIG. 3.

An alternate form of a clinch-type contact 37*a* is shown in FIG. 7. Here a bifurcated conducting member 36A is provided, having a slot 100 and a pair of conducting arm members 102. The slotted bifurcated conducting member 36A lies substantially in the plane of movement of the contact arm 22.

Each of the arm members 102 supports a journal member 104A secured by screws 106A. A bolt 108A extends through holes in the journal members 104A and contact arm 22. A spring-type washer 112, such as a Belleville washer, is mounted upon the bolt 108A by a nut 114 screwed onto the threaded portion 110 of the bolt 108A. Tightening of the nut 114 causes the Belleville washer 112 to generate a residual clamping force in an axial direction with respect to the bolt 108A between the journal members 104A and contact arm 22. When the contact arms 20 and 22 are in a closed position, current flow through the bifurcated conducting member 36A causes the arms 102 to squeeze together and generate an increased clamping force between the journal members 104A and the contact arm 22. This clamping force acting in an axial direction with respect to the bolt 108A produces a low resistance contact between the sides of the arm 22 and the sides of the journal members 104A. Current thus flows from the journal members 104A in an axial direction to the sides of the contact arm 22.

In both FIGS. 6 and 7, it can be seen that slotted conductor means are provided, having a bifurcated members supporting an axial member of the contact arm 22 to allow pivoting movement of the contact arm. Current flow through the bifurcated members causes the arms thereof to squeeze together and generate a clamping force on the contact arm to provide a low resistance path between the bifurcated conductor means and the contact arm.

By providing a clinch-type contact such as shown in FIG. 6 or 7, it is possible to eliminate a flexible conductive shunt member traditionally employed in the prior art. These shunts have higher failure rates than other circuit breaker components, and the elimination of one of them results in a circuit interrupter having significantly greater reliability.

What we claim is:

1. A circuit interrupter, comprising:

first and second separable contacts;

a pivoting contact arm supporting one of said contacts, and comprising an axle member extending through one end of said contact arm and rigidly secured thereto; and conductor means comprising a journal member having a pair of bifurcated upright arms perpendicular to said axle member, each upright arm holding said axle member between the bifurcations thereof to allow pivoting movement of said contact arm, current flow through said contacts also flowing through said conductor means to cause said bifurcations to squeeze together to generate a radial clamping contact force on said axle member and provide a low resistance electrical path between said conductor means and said contact arm.

2. A circuit interrupter as recited in claim 1 wherein each bifurcated upright arm comprises bias means producing a residual clamping force upon said axle member.

3. A circuit interrupter as recited in claim 2 comprising a slotted magnetic drive device having a slot with an open end and a closed end, said contact arm being disposed in said slot, an overcurrent condition through said contacts generating magnetic flux across said slot open end to produce an electrodynamic force upon said contact arm sufficient to overcome said clamping force and drive said contact arm toward said slot closed end, thereby aiding in rapid separation of said contacts.

4. A circuit interrupter as recited in claim 3 wherein said conductor means comprises a conductor member positioned outside of said slotted magnetic drive device and lying substantially in the same plane as said contact arm, current flowing through said contacts also passing through said conductor member in a direction substantially opposite to current flow in said contact arm to form a single turn about the closed end of said slot.

5. A circuit interrupter, comprising:

first and second separable contacts;

a pivoting contact arm supporting one of said contacts and comprising an axle member extending through one end of said contact arm; and conductor means comprising a slotted bifurcated conductor member lying substantially in the same plane as said contact arm, and a pair of arm members at the open end of said slot each perpendicular to said conductor member and supporting a journal bearing, said axle member extending through each of said journal bearings to allow said contact arm to pivot therein;

current flow through said contacts also flowing through each of said arm members to cause said arm members to squeeze together and generate a clamping contact force between said journal members upon said contact arm in a direction parallel to said axle member to establish a low-resistance electrical path between said perpendicular arm members and said contact arm.

6. A circuit interrupter as recited in claim 5 comprising bias means generating a residual clamping force between said journal bearings and said contact arm.

7. A circuit interrupter as recited in claim 6 wherein said axle member comprises a threaded end, and said bias means comprise a spring washer seated upon said pivot member.

8. A circuit interrupter as recited in claim 5 comprising a slotted magnetic drive device having a slot with an open end and a closed end, said contact arm being disposed in said drive device slot such that an overcurrent condition through said contacts generates magnetic flux across said drive device slot to produce an electrodynamic force upon said contact arm sufficient to overcome said clamping force and drive said contact arm toward said drive device slot closed end, thereby separating said contacts.

9. A circuit interrupter as recited in claim 8 wherein said slotted bifurcated conductor member is positioned outside of said slotted magnetic drive device such that said slotted bifurcated conductor member, said journal members, and said contact arm form one turn about the closed end of said slotted magnetic drive device.

10. A circuit interrupter, comprising:

first and second separable contacts;

first and second pivoting contact arms supporting said first and second contacts, respectively;

an operating mechanism connected to said first contact arm for operating said circuit interrupter between open and closed positions;

an axle member extending through one end of said second contact arm;

conductor means comprising a bifurcated member supporting said axle member to allow pivoting movement of said second contact arm, current flow through said contacts also flowing through said conductor means so as to cause said bifurcated member to squeeze together to generate a clamping force on said second contact arm and provide a low resistance electrical path between said conductor means and said contact arm; and electromagnetic drive means for generating contact opening force upon said second contact arm when current flows through said contacts, said contact opening force being sufficient to overcome said clamping force and separate said contacts upon severe overcurrent conditions.

11. A circuit interrupter as recited in claim 10 wherein said electromagnetic drive means comprises a slotted magnetic drive device having a slot with an open end and a closed end, said second contact arm being disposed in said slot such that an overcurrent condition through said contacts generates magnetic flux across said slot to produce an electro-dynamic force upon said second contact arm sufficient to overcome said clamping force and drive said second arm toward said slot closed end, thereby separating said contacts.

12. A circuit interrupter as recited in claim 10 wherein said contact arms are positioned so that current flow therein is in opposite directions.

13. A circuit interrupter as recited in claim 12 wherein said electromagnetic drive means comprises a slotted magnetic drive device having a slot with an open end and a closed end, said second contact arm being disposed in said slot, a severe overcurrent condition through said contacts generating magnetic flux across said slot open end to produce an electrodynamic force upon said second contact arm sufficient to overcome said clamping force and drive said second contact arm toward said slot closed end, thereby separating said contacts.

* * * * *